US010786824B2

(12) United States Patent
Lindsay

(10) Patent No.: US 10,786,824 B2
(45) Date of Patent: Sep. 29, 2020

(54) SPRAY GUN

(71) Applicant: Jim Lindsay Ltd., Saltcoats (GB)

(72) Inventor: James Lindsay, Saltcoats (GB)

(73) Assignee: Jim Lindsay Ltd., Saltcoats (GB)

( * ) Notice: Subject to any disclaimer, the term of this patent is extended or adjusted under 35 U.S.C. 154(b) by 165 days.

(21) Appl. No.: 15/739,280

(22) PCT Filed: Jun. 23, 2016

(86) PCT No.: PCT/GB2016/051885
§ 371 (c)(1),
(2) Date: Dec. 22, 2017

(87) PCT Pub. No.: WO2016/207641
PCT Pub. Date: Dec. 29, 2016

(65) Prior Publication Data

US 2018/0169677 A1 Jun. 21, 2018

(30) Foreign Application Priority Data

Jun. 26, 2015 (GB) ..... 1511245.1

(51) Int. Cl.
*B05B 7/12* (2006.01)
*B05B 1/30* (2006.01)
(Continued)

(52) U.S. Cl.
CPC ..... *B05B 7/1245* (2013.01); *B05B 1/3046* (2013.01); *B05B 7/0081* (2013.01);
(Continued)

(58) Field of Classification Search
CPC ..... B05B 7/0081; B05B 7/062–064; B05B 7/066–068; B05B 7/0815–0846;
(Continued)

(56) References Cited

U.S. PATENT DOCUMENTS 1,475,372 A 11/1923 Day
1,797,209 A * 3/1931 Bramsen ..... B05B 7/1209 239/415
(Continued)

FOREIGN PATENT DOCUMENTS

EP 0706832 A 4/1996
GB 482020 A 3/1938
(Continued)

OTHER PUBLICATIONS

International Search Report for Related British Application No. PCT/2016/051885.
(Continued)

*Primary Examiner* — Cody J Lieuwen
(74) *Attorney, Agent, or Firm* — Miller, Matthias & Hull LLP

(57) ABSTRACT

The invention relates to a low energy spray gun for spraying thin film materials with a thickness of <40 microns such as high performance, thin viscosity nano-paints, lacquers, varnishes and the like. The spray gun comprises a main body (12) having a fluid inlet (14*a*) connected to an external fluid source (not shown) and a fluid outlet nozzle (16*a*). Gas outlets (16*b-d*) on the main body carry entrained fluid droplets emitted from the fluid outlet (14*a*) the shape of which are controlled by horn outlets (24) positioned beyond the fluid outlet (14*a*) and gas outlets (16*b-d*). First and second gas conduits (20, 22) are connected between a common gas inlet (18) and gas outlets (16*b-d*) and horn outlets (24) respectively. The cross-sectional area of a portion of the first gas conduit (20) is reduced relative to that of the second gas conduit (22) thus creating a pressure drop and a discernible improvement in fluid atomisation.

8 Claims, 5 Drawing Sheets

(51) Int. Cl.

| | |
|---|---|
| ***B05B 7/00*** | (2006.01) |
| ***B05B 7/06*** | (2006.01) |
| ***B05B 7/08*** | (2006.01) |
| ***B05B 12/00*** | (2018.01) |
| *B05B 7/24* | (2006.01) |

(52) U.S. Cl.
CPC ..... *B05B 7/068* (2013.01); *B05B 7/0838* (2013.01); *B05B 7/12* (2013.01); *B05B 12/002* (2013.01); *B05B 7/2435* (2013.01); *B05B 7/2478* (2013.01); *B05B 7/2489* (2013.01)

(58) Field of Classification Search
CPC ..... B05B 7/0861; B05B 7/0869; B05B 7/1209–1245; B05B 12/002; B05B 15/63; B05B 1/3046
USPC ..... 239/414, 527, 528, 586
See application file for complete search history.

(56) References Cited

U.S. PATENT DOCUMENTS

| | | | | | |
|---|---|---|---|---|---|
| 1,982,055 | A * | 11/1934 | Jenkins | B05B 7/0815 | 239/301 |
| 1,982,056 | A | 11/1934 | Jenkins | | |
| 2,079,933 | A | 5/1937 | Fisher | | |
| 2,504,117 | A | 4/1950 | Downs | | |
| 2,958,471 | A | 11/1960 | Zippel | | |
| 3,006,559 | A * | 10/1961 | Schmidt | B05B 7/0876 | 239/414 |
| 3,235,186 | A * | 2/1966 | Boyce | B05B 7/0815 | 239/415 |
| 3,747,850 | A | 7/1973 | Hastings et al. | | |
| 4,702,420 | A | 10/1987 | Rath | | |
| 4,917,300 | A | 4/1990 | Gloviak et al. | | |
| 5,613,637 | A * | 3/1997 | Schmon | B05B 7/0815 | 239/296 |
| 5,803,367 | A * | 9/1998 | Heard | B05B 7/0815 | 239/296 |
| 6,793,157 | B1 | 9/2004 | Lindsay et al. | | |
| 2005/0145718 | A1 | 7/2005 | Blette et al. | | |
| 2010/0163648 | A1 * | 7/2010 | Olson | B05B 7/1218 | 239/407 |
| 2012/0097762 | A1 * | 4/2012 | Gehrung | B05B 7/0815 | 239/291 |

FOREIGN PATENT DOCUMENTS

| | | | |
|---|---|---|---|
| GB | 508719 | A | 7/1939 |
| GB | 2485566 | A | 5/2012 |
| JP | 2001129444 | A | 5/2001 |
| WO | 0024521 | A2 | 5/2000 |
| WO | 0166261 | A2 | 9/2001 |
| WO | 2011062752 | A2 | 5/2011 |
| WO | 2012040887 | A1 | 4/2012 |

OTHER PUBLICATIONS

Search Report for Related British Application No. GB1511245.1; report dated Dec. 22, 2015.
International Search Report for Related British Application No. PCT/GB2016/051885; report dated Sep. 28, 2016.

* cited by examiner

Sectional Plan

Trigger Off Position

Trigger Off

Trigger On Position

Trigger Activated

SPRAY GUN

FIELD OF THE DISCLOSURE

The present invention relates to a spray gun and particularly, though not exclusively, to a low energy spray gun for spraying thin film materials with a thickness of ≤40 microns. The spray gun of the present invention is particularly suitable for spraying high performance, thin viscosity nano paints, lacquers, varnishes and the like.

BACKGROUND OF THE DISCLOSURE

Spray guns are commonly used where there is a requirement for quick and accurate coating of a surface. In some industrial applications, e.g. automotive and aerospace, it is particularly important to be able to apply coatings to a surface having predictable characteristics, e.g. uniform thickness. The applicant's pending UK patent application No. 1414281.4 filed on 12 Aug. 2014 discloses one such example of a spray gun which allows a user to finely adjust spray characteristics—e.g. flow rate and pattern—in a controlled fashion by means of specially adapted trigger and flow adjustment mechanisms.

Whilst the aforementioned spray gun provides several advantages over the prior art in terms of improved trigger alignment, reliability and more accurate spraying characteristics, it is nevertheless not particularly well suited to applying thin film coatings having a thickness of the order of ≤40 microns. There is therefore a requirement in the art for an ergonomic spray gun which is easier to use, and has the ability to uniformly apply thin film coatings having a thickness of ≤40 microns, e.g. for spraying paints, lacquers, varnishes and the like, including those containing nano particles and/or isocyanate hardeners.

SUMMARY OF THE DISCLOSURE

According to a first aspect of the present invention there is provided a spray gun apparatus comprising:

- a main body;
- a fluid inlet on the main body connectable to an external fluid source;
- a fluid outlet on the main body;
- a gas outlet on the main body for carrying entrained fluid droplets emitted from the fluid outlet;
- a horn outlet positioned on the main body beyond the fluid outlet and gas outlet for controlling the shape of the entrained fluid droplets; and
- a first gas conduit within the main body connected between a gas inlet and the gas outlet;
- a second gas conduit within the main body connected between a gas inlet and the horn outlet; and
- a fluid conduit within the main body connected between the fluid inlet and the fluid outlet;

wherein a common gas inlet is provided for the first and second gas conduits and is connectable to an external pressurised gas source.

By providing a common gas inlet, the balance of the spray gun apparatus is improved by reducing weight at its input end. Excess weight caused by dual gas inlets—including associated regulators and gauges—found in prior art spray guns contributes to an inherent imbalance resulting in a tendency for a user to compensate by manually holding the dual gas inlet hoses during operation. Advantageously, the more balanced spray gun apparatus of the present invention frees up a user's second hand which can instead be used to operate body-mounted dual conduit controls to optimise spray characteristics during spraying. This ergonomic improvement is particularly important when the spray gun apparatus is used to apply thin film coatings having a thickness of ≤40 microns, e.g. for spraying paints, lacquers, varnishes and the like, including those containing nano particles and/or isocyanate hardeners. In such circumstances, it may be necessary to fine tune the atomising pressure at the spray outlet (i.e. nozzle) and/or spray fan shape/width during spraying. The present invention facilitates this whilst reducing the user fatigue inherent in the operation of prior art spray guns.

Optionally, the cross-sectional area of at least a portion of the first gas conduit is reduced relative to that of the second gas conduit.

The reduction in cross-sectional area causes a gas pressure drop at the gas outlet (also known as the air cap annulus). A discernible improvement in fluid atomisation has been observed as a consequence of the pressure drop, particularly for a range of viscous fluids.

A problem associated with conventional spray guns having only a single gas conduit has been gas flow at the gas outlet being siphoned off to the horn outlet, this being a contributory factor to poor fluid atomisation. Previously, in order to address that problem, it has been necessary to increase the overall gas flow rate to the gas outlet to compensate for the loss of pressure arising from this siphoning effect. However, when spraying more viscous fluids, the presence of small bore holes at the gas outlet (air cap annulus) results in non-laminar airflow at pressures exceeding approximately 15 psi (circa. 103 kPa). The resulting turbulence increases with increasing pressure. The provision of separated first and second gas conduits obviates the siphoning issue and allows gas flow pressures to be limited to 15 psi (circa. 103 kPa) or less, even when spraying more viscous fluids such as emulsion paints. Furthermore, by adjusting the cross-sectional area of at least a portion of the first gas conduit the ratio of gas flow between the first and second gas conduits can be controlled when a common gas inlet is employed.

Optionally, a primary valve is provided within the main body upstream of the gas outlet for opening or closing the respective first and second gas conduits.

Optionally, a port of the primary valve is alignable with the first gas conduit, said port defining a portion of the first gas conduit having a reduced cross-sectional area relative to that of the second gas conduit.

Optionally, the port has a length which is between 3 and 4 times its diameter.

It will be appreciated that the cross-sectional area of the port is also reduced relative to that of the remainder of the first gas conduit. The port—which may have a length which is approximately three times its diameter to ensure laminar airflow—takes the form of a cylinder of constant diameter. Testing has confirmed that, as a consequence of its proximity to gas outlet, the pressure drop of the gas flow within the port itself does not recover by the time it reaches the gas outlet. This ensures a differential in terms of both gas pressure and gas velocity between the first and second gas conduits which promotes better fluid atomisation at the gas outlet when a common gas inlet is employed.

Optionally, the cross-sectional area of at least a portion of the first gas conduit is between 40% and 45% of that of the second gas conduit.

During testing, it has been found that when the cross-sectional area of a portion of the first gas inlet conduit is approximately 41% of that of the second gas conduit, this produces a localised 3 psi (~20.7 kPa) reduction in gas pressure from 15 psi to 12 psi (~103.4 kPa to ~82.7 kPa). In the illustrated example, the gas inlet (and outlet) conduit has a diameter of 4.5 mm whereas the valve port, which separates the two, has a diameter of 2.8 mm (over a length of approximately 9.5 mm). It will be appreciated that a reduction in cross-sectional diameter of the valve port correlates with pressure drop in a linear fashion.

Optionally, regulator valves are provided in the respective first and second gas conduits at an upstream position relative to the primary valve.

The body mounted regulator valves can be used to effect adjustment and rebalancing of the gas pressures at the gas outlet (also known as the air cap annulus) and the horn outlet respectively. For example, slight changes in the viscosity of fluids being sprayed (which are also dependent on environmental temperature) require different pressure ratios between the gas and horn outlets to ensure optimum atomisation and spraying characteristics. The regulator valves facilitate such fine tuning.

Optionally, the primary valve is a trigger-operated valve provided with two spaced valve ports for simultaneously opening or closing the respective first and second gas conduits.

Optionally, the spray gun apparatus further comprises a primary trigger lever pivotally mounted on the main body for manually operating the trigger-operated valve.

Optionally, the primary trigger lever is also co-operable with a fluid flow adjustment mechanism, the adjustment mechanism controlling the fluid flow rate from the fluid outlet after the trigger-operated valve ports are opened.

Optionally, the primary trigger lever is co-operable with a fluid flow adjustment mechanism via a secondary trigger lever pivotally mounted on the main body.

Optionally, the fluid flow adjustment mechanism comprises a pair of actuation arms disposed on either side of the main body, said actuation arms being actuatable against a spring bias by the trigger lever and directly or indirectly engageable with an abutment surface of a fluid needle which is biased to close the fluid outlet.

Optionally, a slider mechanism is provided on the main body, the actuation arms being threadably engageable therewith.

Optionally, an adjuster nut is threadably engageable with the slider mechanism, the adjuster nut being provided with an abutment surface for abutting against the abutment surface of the fluid needle.

By providing a threadable engagement between the adjuster nut and the slider mechanism the initial clearance between the respective abutment surfaces of the adjuster nut and the fluid needle can be selected by a user. Furthermore, by providing a threadable engagements between the respective actuation arms and the slider mechanism adjustments can be made to take account of any machining tolerances thus ensuring a smooth and reliable trigger action. It will be appreciated that the threadable engagements provide a user with the ability to: (i) precisely control the fluid flow rate from the fluid outlet or nozzle; (ii) ensure smooth trigger action whilst exerting the minimum amount of trigger pressure; (iii) consistently repeat a predetermined fluid flow rate; and (iv) adjust the fluid flow rate to correct to account for different application rates for different fluid viscosities, and the differing application rates of different operators.

BRIEF DESCRIPTION OF THE DRAWINGS

Embodiments of the present invention will now be described, by way of example only, with reference to the accompanying drawings, in which:

FIG. 4*b* is a cross-sectional schematic top view corresponding to FIG. 4*a* showing the reduced clearance between the respective abutment surfaces of the adjuster nut and the fluid needle; and.

DETAILED DESCRIPTION

Conventional spray guns employ a common gas conduit leading, in series, from a gas inlet to an gas outlet or air cap annulus (i.e. an atomising outlet), and onwards through a valve to a horn outlet. The ratio of airflow escaping through the gas outlet and horn outlet is dependent on the relative cross-sectional areas of the respective sets of outlet apertures. As the viscosity of an emitted fluid increases or decreases, the pressure at the individual gas outlets must be increased or decreased relative to the viscosity of the fluid being sprayed. This creates an imbalance in the gas flow being emitted from the respective sets of outlets. At one extreme, the bleeding of airflow towards the horn outlet results in the annular gas outlet being starved of the necessary atomising airflow to the extent that conventional spray guns of this type are incapable of applying higher viscosity fluids such as emulsion paints. The applicant's pending UK patent application No. 1414281.4 filed on 12 Aug. 2014 discloses one such example of a spray gun which addresses the above problem. However, the spray gun disclosed therein utilises two gas inlets.

Figure 1A:
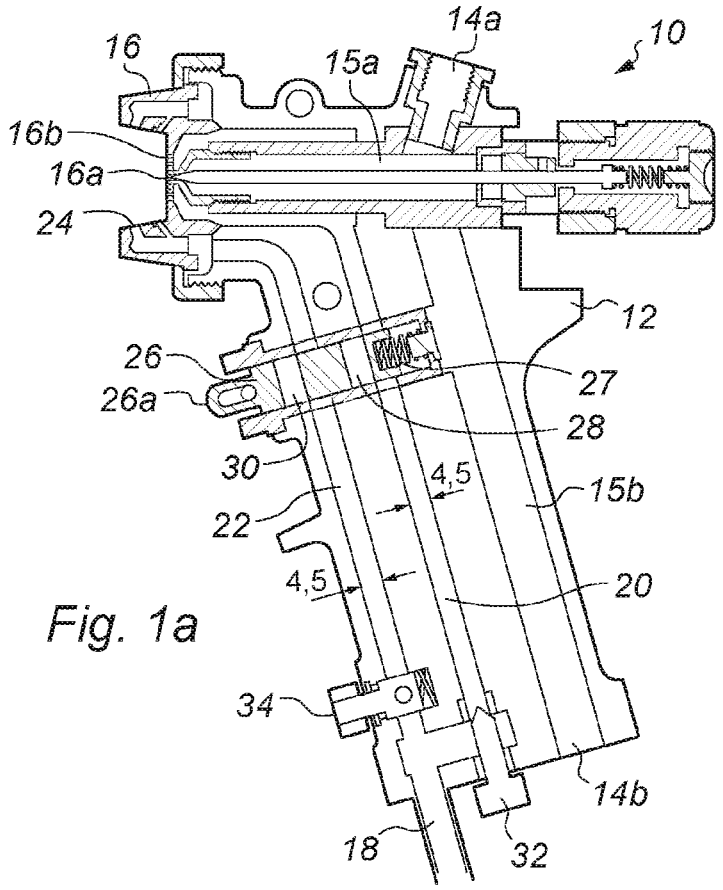
FIG. 1*a* is a cross-sectional schematic side view through the main body of the spray gun of the present invention.

Referring to FIG. 1*a*, the spray gun apparatus 10 of the present invention comprises a main body 12, a fluid inlet 14*a*, and a gas outlet or air cap 16. Fluid is conveyed through the main body 12 from the fluid inlet 14*a* via a fluid conduit 15*a* and, in the absence of gas flow from the horn outlets 24, is emitted from a central fluid outlet nozzle 16*a* and atomised at the annular gas outlet 16*b* so as to produce a "circular spray" or "round fan" pattern. The fluid inlet 14*a* in FIG. 1*a* is of the "gravity feed" type which is connectable to a gravity cup (not shown). Fluid flows from the gravity cup into an upper fluid conduit 15*a* to the fluid outlet nozzle 16*a*.

In an alternative spray gun apparatus 10 (not shown), the fluid inlet 14*b* may be of the "pressure feed" type. This arrangement can be provided by rotating the upper fluid conduit 15*a* by 180 degrees so as to be aligned with a lower fluid conduit 15*b* which is connectable to an external pressurised fluid source (not shown). It will be appreciated that the present invention encompasses both types of spray guns, i.e. pressurised or gravity feed.

Figure 1B:
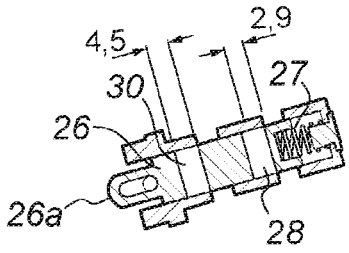
FIG. 1*b* is a cross-sectional schematic side view through the primary valve for opening or closing the respective first and second gas conduits within the valve body.
Figure 1C:
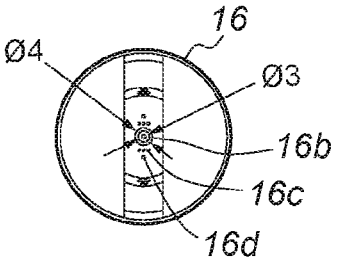
FIG. 1*c* is a front view of the gas outlet or air cap showing central fluid outlet nozzle, individual circular and annular propellant gas outlets, and twin horn gas outlets.

The atomised fluid droplets are entrained in a propellant gas which travels through the main body 12 from a common gas inlet 18, via a first gas conduit 20, to gas outlet annulus 16*b* and bores 16*c* of the spray head or air cap. The gas outlet 16*b* includes an annular aperture which surrounds the central fluid outlet nozzle 16*a* (see FIG. 1*c*). In the illustrated example, the diameter of the central fluid outlet nozzle 16*a* is 3 mm; and the diameter of the surrounding annular aperture of the gas outlet 16*b* is 4 mm. Surrounding the annular aperture in the illustrated embodiment are six bore holes 16*c* of 0.5 mm diameter and two further bore holes 16*d* of 0.8 mm diameter. The combined cross-sectional area of the annular aperture of the gas outlet 16*b* and the surrounding bore holes is 7.9 $mm^2$. The bore holes have a focal point located beyond the front face of the gas outlet (or air cap) 16*b* for creating a "round fan" spray pattern.

A portion of the propellant gas arriving at the common gas inlet 18 travels through the main body 12, via a second gas conduit 22, to horn outlets 24 of the spray head or air cap 16. The horn outlets 24 in the illustrated embodiment comprise two bore holes of 2 mm diameter and two bore holes of 1 mm diameter. The combined cross-sectional area of the horn outlet is 7.7 $mm^2$, i.e. marginally less than the combination of the annular aperture of the gas outlet 16*b* and surrounding bore holes 16*c/d*. The horn outlets 24 are located beyond both the central fluid outlet nozzle 16*a* and the propellant gas outlet 16*b* and are angled inwardly so as to control the shape created by the entrained fluid droplets as they are emitted from the spray head or air cap 16, e.g. by changing the default "round fan" pattern to a "flat fan" pattern.

The present invention has undergone testing using common household emulsion paints. This testing has established that in order to provide a controlled finish of acceptable quality a pressure of approximately 9 psi (~62.1 kPa) is required at the gas outlet 16*b*; and a pressure of approximately 12 psi (~82.7 k Pa) is required at the horn outlets 24, i.e. the horn outlets 24 require approximately 25% more pressure than the gas outlet 16*b*. This ensures an adequate level of atomisation and an optimal flat-fan spray pattern providing an even film thickness with a very smooth finish.

However, in conventional air spray guns, it has been observed from test results that the use of pressures in excess of approximately 15 psi (~103 kPa) creates significant turbulence (and therefore a back pressure behind the spray head or air cap 16) at the small bores 16*c* of the gas outlets resulting in airflow being redirected to the horn outlets 24. For some paint viscosities this may result in poor fluid atomisation at the gas outlets and an unacceptable paint finish. As pressure is increased, the imbalance of the gas flow rate also increases in a non-linear fashion resulting in a deterioration of atomisation. Consequently, viscous paints such as emulsions are normally applied by high pressure airless spraying at pressures of 1,500-1,800 psi (approx. 10,300-12,400 kPa).

The first two columns of the below table show total gas flow rates through each of the two gas conduits of the spray gun of the present invention at different input pressures when operated in the flat fan mode, i.e. whereby regulator valves 32 and 34 are fully open.

| Pressure Psi | Flow Meter Reading ltr/min | Air Density $Kg/m^3$ | Absolute Flow $cm^3/sec$ | Velocity cm/sec | Area $mm^2$ | Dia Bore mm |
|---|---|---|---|---|---|---|
| 15 | 100 | 2.4 | 833 | 12,900 | 6.4 | 2.80 |
| 12 | 90 | 2.7 | 750 | 12,170 | 6.1 | 2.78 |
| 9 | 80 | 3.2 | 667 | 11,180 | 5.9 | 2.75 |
| 6 | 64 | 4.2 | 533 | 9,759 | 5.46 | 2.70 |
| 3 | 48 | 7.2 | 400 | 7,454 | 5.36 | 2.65 |

In order to optimise the spray characteristics by creating the required 25% pressure differential, the diameter of a portion of the first gas conduit is reduced from approximately 4.5 mm to approximately 2.8 mm, thus resulting in an approximate 3 psi (20.7 kPa) pressure drop when the input pressure is approximately 15 psi (~103.42 kPa). The calculations used to produce the data in the first row of the above table are provided below. As the input pressure decreases, the diameter of a portion of the first gas conduit requires to be reduced below 2.8 mm. However, the user can compensate for the fact that the bore diameter is 2.8 mm by reducing the flow rate through the first gas conduit via the regulator valve 32.

1. Find the Density of Air at a known pressure

| | |
|---|---|
| Pressure [psi] 15 | Density = S.G. × Absolute/Gauge |
| S.G. of Air ($kg/m^3$) 1.2 = | 2.4 $Kg/m^3$ Density |

2. Find Absolute Flow from Test Reading of 102 ltr/min @ 15 psi (i.e. 204 ltr/min reading taken from above table divided by two given that flow is divided evenly between two gas flow conduits)

| | |
|---|---|
| | Flow = Reading × Gauge/Absolute |
| | 100 *15/30 |
| Flow meter reading | |
| ltr/min 100 | 50 ltr/min |
| Gauge Reading = PSI 15 | 50,000 $cm^3/min$ |
| Absolute = Gauge + 15 psi 30 | 833 $cm^3/sec$ Flow |

3. Create a 3 psi (20,000 Pascal) Pressure loss thru a 4.5 mm Bore $\Delta P$ = Pressure Loss

| | |
|---|---|
| Pascal 20,000 | $\Delta P = 0.5\ \rho\ V^2$ |
| $\rho$ = air density ($Kg/m^3$) 2.4 | $V^2 = \Delta P/0.5\rho$ |
| V = Velocity (mtr/sec) | $V^2 = 16{,}667\ (20000/2.4 * 0.5)$ |
| | $v = \sqrt{16{,}667}$ |
| | v = 129 mtr/sec |
| | 12,900 cm/sec Velocity |

4. Find the area of bore that will give a 3 psi Pressure Drop

| | |
|---|---|
| | Velocity = Flow/Area |
| | Area = Flow/Velocity 0.064 $cm^2$ |
| | Area = 6.4 $mm^2$ Area |

5. Find the bore diameter from the Area

| | |
|---|---|
| $\Pi = 3.142$ | Area = $\Pi r^2$ |
| | $r^2 = \text{Area}/\Pi$ |
| 6. Check Pressure loss | 2.037 |
| $\Delta P = 0.5\ \rho\ V^2$ | $r = \sqrt{2.037}$ |
| $0.5 \times 2.4 \times 129^2$ | 1.40 Radius |
| | 2.8 mm |
| | Bore Diameter |
| 19,969 Pascal | |
| ~3 psi | |
| (14.5 psi = 1 Bar = 100,000 Pascal) | |

The use in the present invention of a common gas inlet 18 which divides into separate first and second gas conduits 20, 22, with a pressure differential between the two, makes it possible to control the airflow ratio between the gas outlets 16*b* and the horn outlets 24 respectively. A further advantage associated with the use of lower pressures (i.e. approximately 15 psi (~103 kPa or less)) is that problems such as surface "bounce", misting, poor paint adhesion, poor paint finish, and colour loss are all avoided.

A trigger-operated valve 26 (shown in isolation in FIG. 1*b*) is resiliently mounted within the main body 12 upstream of the spray outlet nozzle 16, and downstream of the common gas inlet 18. The valve 26 is provided with first and second spaced apart ports 28, 30. The valve 26 is biased by means of a coil spring 27 into a closed position in which the first and second ports 28, 30 are out of alignment with the corresponding first and second gas conduits 20, 22. The first and second ports 28, 30 are each cylindrical and have a length which is between 3 and 4 times their diameter. The diameter of the first gas conduit 20 is the same as the diameter of the second gas conduit 22. In the illustrated example the diameter of each conduit 20, 22 is 4.5 mm.

The diameter of the first port 28 is reduced relative to that of the remainder of the first gas conduit 20. In the illustrated example the diameter of the first port 28 is 2.8 mm whereas the diameter of the second port 30 is 4.5 mm.

When the trigger-operated valve 26 is moved against the bias of spring 27 the first and second ports 28, 30 into an open position in which the first and second ports 28, 30 are aligned with the corresponding first and second gas conduits 20, 22. The flow rate of gas entering the respective first and second gas conduits 20, 22 is further controllable via manually operable first and second regulator valves 32, 34 proximate the common gas inlet 18.

The reduction in cross-sectional area within the first gas conduit 20 causes a gas pressure drop upstream of the valve port 28. A discernible improvement in fluid atomisation has been observed as a consequence of this pressure drop for the reasons described above.

Figure 2A:
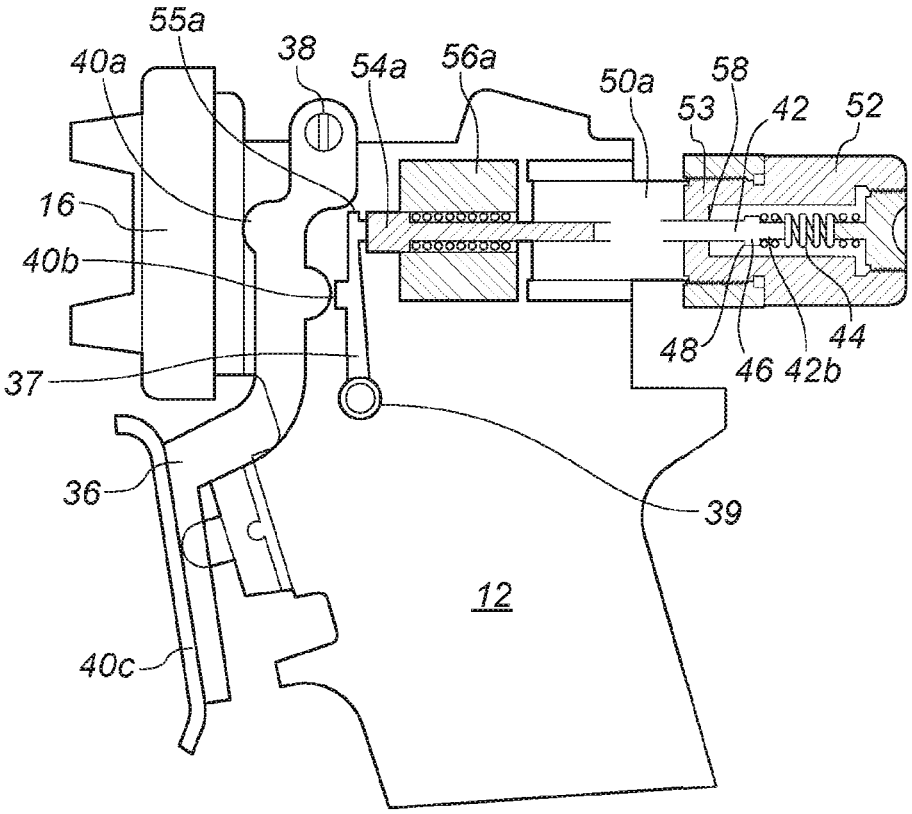
FIG. 2*a* is partial cross-sectional schematic side view illustrating the interaction of a piston, slider mechanism and adjuster nut of the fluid flow adjustment mechanism.
Figure 3A:
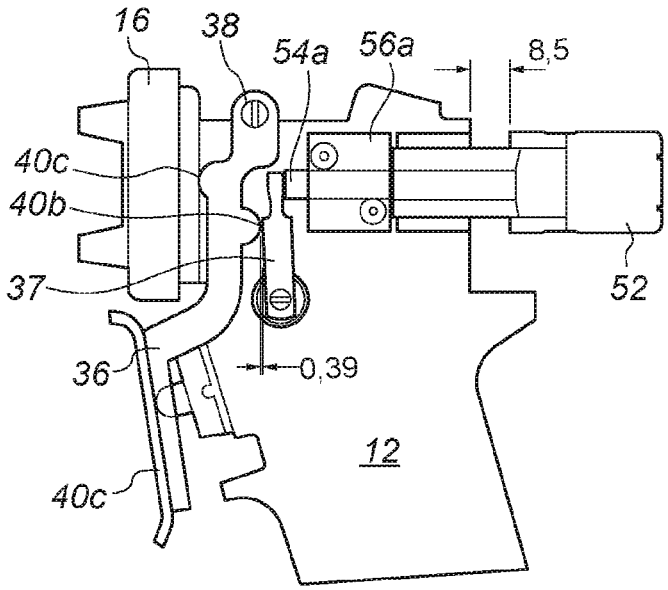
FIG. 3*a* is partial cross-sectional schematic side view illustrating relative positions of the primary trigger lever and the piston before operation of the spray gun apparatus.
Figure 4A:
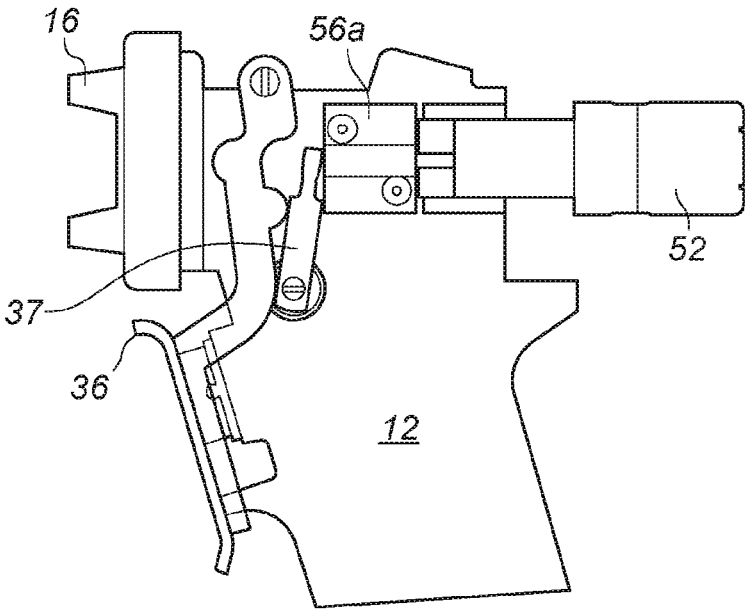
FIG. 4*a* is partial cross-sectional schematic side view illustrating relative positions of the primary trigger lever and the piston during operation of the spray gun apparatus.

The trigger-operated valve 26 is manually actuated by means of a primary trigger lever 36 (FIG. 2*a*) which is mounted to opposite sides of the main body 12 at pivot axis 38 for pivotal movement between a non-actuated (FIG. 3*a*) and an actuated (FIG. 4*a*) position. The trigger-operated lever 36 is provided with three pairs of contact surfaces 40*a*, 40*b*, 40*c* the purpose of which is discussed below.

Figure 2B:
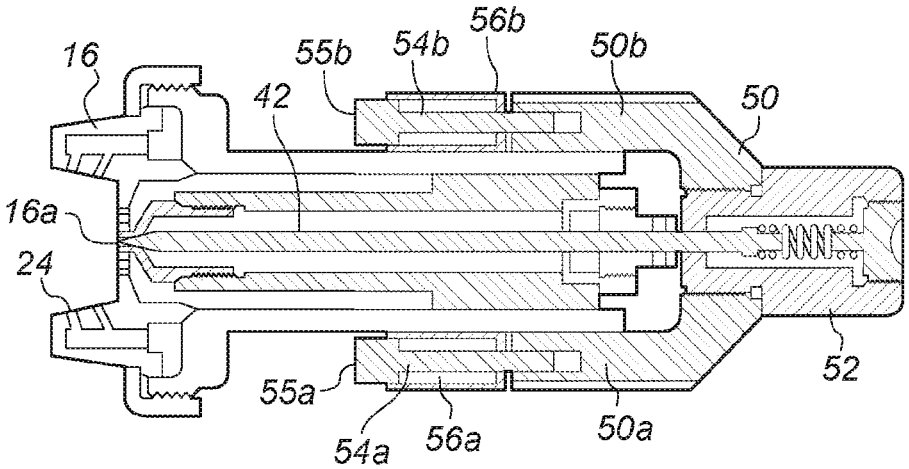
FIG. 2*b* is a cross-sectional schematic top view of the fluid flow adjustment mechanism shown in FIG. 2*a;*
Figure 3B:
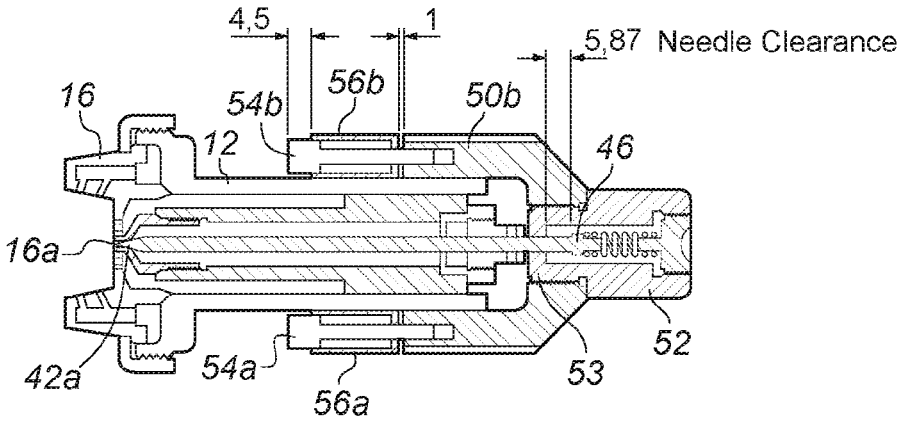
FIG. 3*b* is a cross-sectional schematic top view corresponding to FIG. 3*a* showing the initial clearance between the respective abutment surfaces of the adjuster nut and the fluid needle.
Figure 4B:
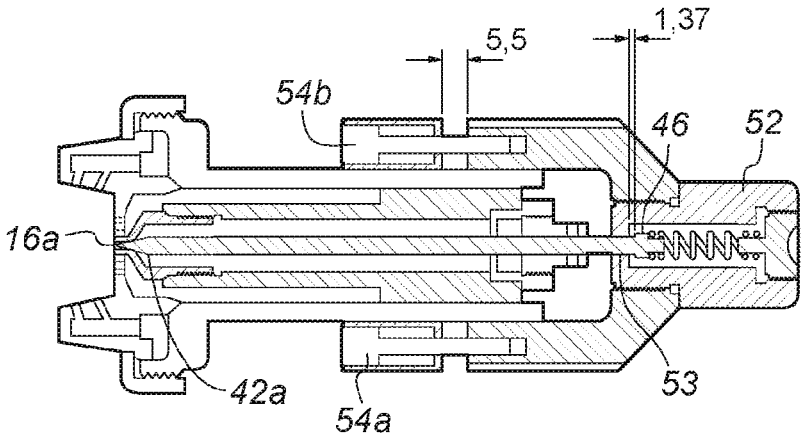

A fluid flow adjustment mechanism is attached to the main body 12 and comprises a fluid needle 42 which is biased by a coil spring 44 such that a needle end 42*a* closes the central fluid outlet nozzle 16*a*, as best shown in FIGS. 3*b* and 4*b*. The opposite needle end 42*b* is provided with an outwardly extending collar 46 which presents an annular abutment shoulder 48. As best shown in FIG. 2*b*, two halves 50*a*, 50*b* of a slider mechanism 50 are disposed on each side of the main body 12 and are threadably connected, at their ends lying furthest from the spray head or air cap 16, to an adjuster nut 52. The adjuster nut 52 is located at the rear of the main body 12 and its central axis is coaxial with the longitudinal axis of the fluid needle 42. The adjuster nut 52 is provided with an internal recess which accommodates the needle end and its outwardly extending collar 46. The end of the adjuster nut 52 which is threadably engaged with the slider mechanism 50 is provided with an inwardly extending collar 53 which presents an annular abutment shoulder 58.

The ends of the slider mechanism halves 50*a*, 50*b* lying closest to the spray head or air cap 16 are each threadably connected to an actuation arm 54*a*, 54*b*. The actuation arms 54*a*, 54*b* extend through guide members 56*a*, 56*b* fixed to the opposing lateral sides of the main body 12. The free ends of the actuation arms 54*a*, 54*b* are biased by coil springs so as to protrude from their guide members 56*a*, 56*b* and provide abutment surfaces 55*a*, 55*b* facing the spray head or air cap 16. A secondary trigger lever 37 is mounted to opposite sides of the main body 12 at pivot axis 39 for pivotal movement between a non-actuated position, and an actuated position described below.

When the primary trigger lever 36 is in its non-actuated condition (FIG. 3*a*) the contact surfaces 40*a* closest to the pivot axis 38 abut against a rear shoulder surface proximate the spray head or air cap 16. When the primary trigger lever 36 is partially actuated—by manual anti-clockwise movement of the trigger lever 36—the contact surfaces 40*a* disengage from the aforementioned rear shoulder surface and the contact surfaces 40*c* furthest from the pivot axis 38 abut a protrusion 26*a* on the valve 26. In doing so, the first and second valve ports 28, 30 move into partial alignment with the corresponding first and second gas conduits 20, 22. The contact surfaces 40*b* lie between contact surfaces 40*a*, 40*c* but face away from the spray outlet nozzle 16.

When the primary trigger lever 36 is fully actuated the contact surfaces 40*c* furthest from the pivot axis 38 continue to abut the protrusion 26*a* on the valve 26—thereby fully aligning the corresponding valve ports 28, 30 and gas conduits 20, 22—and contact surfaces 40*b* abut the secondary trigger levers 37. In doing so, the secondary trigger levers 37 move in a clockwise direction to transfer the manually applied actuation force to the fluid flow adjustment mechanism.

More specifically, the actuation force is transferred: (i) from a user to the primary trigger lever 36; (ii) from the primary trigger lever 36 to the secondary trigger levers 37; (iii) from the secondary trigger levers 37 to the pair of actuation arms 54*a*, 54*b*; (iv) from the pair of actuation arms 54*a*, 54*b* equally through the two halves 50*a*, 50*b* of the slider mechanism 50; and (v) from the slider mechanism 50 to the adjuster nut 52.

Figure 4C:
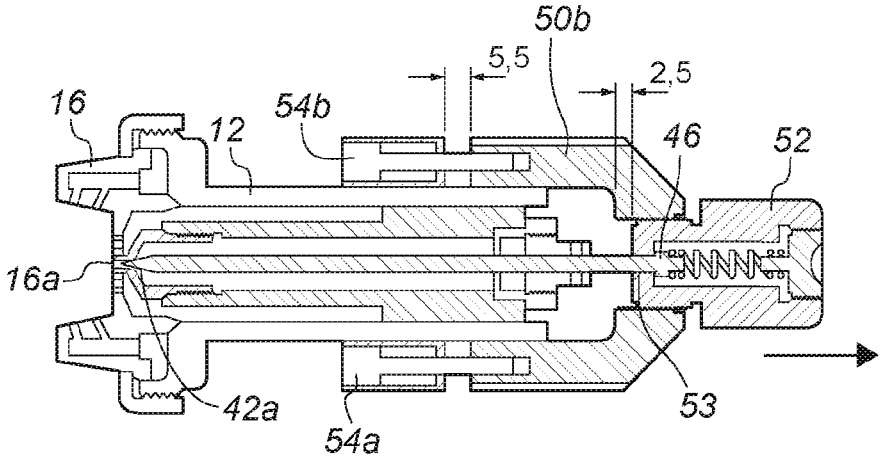
FIG. 4*c* is a cross-sectional schematic top view corresponding to FIGS. 4*a* and 4*b* showing the adjuster nut retracting the needle so as to permit fluid flow through the nozzle.

In the embodiment illustrated in FIG. 4*b*, the adjuster nut 52 is longitudinally positioned relative to the slider mechanism 50 such that full actuation of the primary trigger lever 36 is insufficient to bring its inwardly extending annular abutment shoulder 58 into engagement with the outwardly extending annular abutment shoulder 48 of the fluid needle 42, i.e. the central fluid outlet nozzle 16*a* remains closed because the fluid needle end 42*a* is biased by the resilience of coil spring 44. Accordingly, fluid flow will not commence through the central fluid outlet nozzle 16*a* until the adjuster nut 52 is manually rotated anti-clockwise to a position such as that shown in FIG. 4*c*, i.e. to the extent that the inwardly extending annular abutment shoulder 58 engages with the outwardly extending annular abutment shoulder 48 and overcomes the closing force of the coil spring 44. It will be appreciated that such an arrangement provides a user with a high precision means of controlling the rate of fluid flow, this fine tuning ability being particularly beneficial when spraying nano paints, lacquers, varnishes and the like. Advantageously, when configured as illustrated in the figures, fluid flow is controllable independently of the gas flow via primary trigger lever 36 thus providing the necessary accuracy and repeatability for application of thin films.

In practice, the diameter of a portion of the first gas conduit 20 may be selected to be greater than the 2.8 mm indicated in the above table and calculations. Whilst this may result in a non-optimal fluid atomisation velocity, i.e. one which is too high having regard to the input pressure, appropriate manual adjustment of the regulator valve 32 can be used to restrict gas flow thus allowing more gas flow to be directed into the second gas conduit 22. The gas flow directed into the second gas conduit 22 may itself be regulated by the regulator valve 34.

The users of spray guns generally "work by eye" rather than relying on pressure gauges. Experienced users know that too high a gas flow rate at the spray outlet tends to result in a dry finish and also creates "bounce back" mist. Conversely, an insufficient gas flow rate at the spray outlet tends to result in a ragged edge to the spray pattern and/or an undesirable orange peel surface finish effect. These effects can be avoided when using a spray gun of the present invention by facilitating fine tuning optimisation of the flow rates through the fluid outlet nozzle 16*a* and the first and second gas conduits 20 and 22.

It will be appreciated that the screw thread connections between the actuation arms 54*a*, 54*b* and the slider mechanism 50; and between the slider mechanism 50 and the adjuster nut 52; each provide a means of effecting minor corrections to accommodate manufacturing tolerances. It is essential that the secondary trigger levers 37 each contact the actuation arms 54*a*, 54*b* simultaneously to avoid misalignment or jamming of the fluid flow adjustment mechanism. For example, the primary trigger lever 36 may be manufactured by stamping and folding a metal sheet and complete symmetry may be difficult to achieve. However, the inherent adjustability of the actuation arms 54*a*, 54*b* allows the user to employ feeler gauges to achieve consistently accurate and repeatable force transfer irrespective of manufacturing tolerances. The invention therefore allows the use of lower cost parts without any compromise in terms of spray characteristics.

It is contemplated by the inventor that various substitutions, alterations, and modifications may be made to the invention without departing from the scope of the invention as defined by the accompanying claims. For example, whilst it is envisaged that the fluid droplets will be paints, lacquers, varnishes and the like, it will be appreciated that flowable solids such as glues and bonding agents may also be sprayed. The propellant gas will usually be air from a pressurised source (not shown).

The invention claimed is:

1. A spray gun apparatus comprising:

a main body;

a primary trigger lever pivotally mounted on the main body via a pivot axis;

a fluid inlet on the main body connectable to an external fluid source;

a fluid outlet on the main body;

a gas outlet on the main body for carrying entrained fluid droplets emitted from the fluid outlet;

a horn outlet positioned on the main body beyond the fluid outlet and gas outlet for controlling the shape of the entrained fluid droplets; and a first gas conduit within the main body connected between a common gas inlet and the gas outlet;

a second gas conduit within the main body connected between the common gas inlet and the horn outlet; and a fluid conduit within the main body connected between the fluid inlet and the fluid outlet;

wherein the common gas inlet is connectable to an external pressurised gas source;

wherein the cross-sectional area of at least a portion of the first gas conduit is reduced relative to that of the second gas conduit;

wherein a primary valve having first and second spaced apart valve ports is provided within the main body upstream of the gas outlet for opening or closing the respective first and second gas conduits;

wherein the first valve port of the primary valve is alignable with the first gas conduit, said first valve port defining the portion of the first gas conduit having the reduced cross-sectional area relative to that of the second gas conduit;

wherein the primary trigger lever is manually operable to cause a contact surface thereon separated from the pivot axis to abut a protrusion on the primary valve and cause the first and second spaced apart valve ports to move and simultaneously open or close the respective first and second gas conduits; and wherein the primary trigger lever is also co-operable with a fluid flow adjustment mechanism, the fluid flow adjustment mechanism controlling the fluid flow rate from the fluid outlet after the first and second spaced apart valve ports are opened.

2. A spray gun apparatus according to claim 1, wherein the first valve port has a length which is between 3 and 4 times its diameter.

3. A spray gun apparatus according to claim 1, wherein the cross-sectional area of at least the portion of the first gas conduit is between 40% and 45% of that of the second gas conduit.

4. A spray gun apparatus according to claim 1, wherein regulator valves are provided in the respective first and second gas conduits at an upstream position relative to the primary valve.

5. A spray gun apparatus according to claim 1, wherein the primary trigger lever is co-operable with the fluid flow adjustment mechanism via a secondary trigger lever pivotally mounted on the main body.

6. A spray gun apparatus according to claim 1, wherein the fluid flow adjustment mechanism comprises a pair of actuation arms disposed on either side of the main body, said actuation arms being actuatable against a spring bias by the trigger lever and directly or indirectly engageable with an abutment surface of a fluid needle which is biased to close the fluid outlet.

7. A spray gun apparatus according to claim 6, wherein a slider mechanism is provided on the main body, with pistons being threadably engageable therewith.

8. A spray gun apparatus according to claim 7, wherein an adjuster nut is threadably engageable with the slider mechanism, the adjuster nut being provided with an abutment surface for abutting against the abutment surface of the fluid needle.

* * * * *